US010444686B2

(12) United States Patent
Miyai

(10) Patent No.: US 10,444,686 B2
(45) Date of Patent: Oct. 15, 2019

(54) IMAGE FORMING APPARATUS DISPLAYING SPECIFIC INFORMATION RELATING TO REPLACEMENT COMPONENT ON DISPLAY

(71) Applicant: KYOCERA Document Solutions Inc., Osaka (JP)

(72) Inventor: Hiroyuki Miyai, Osaka (JP)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 16/201,281

(22) Filed: Nov. 27, 2018

(65) Prior Publication Data

US 2019/0163106 A1 May 30, 2019

(30) Foreign Application Priority Data

Nov. 27, 2017 (JP) ..... 2017-226740

(51) Int. Cl.
*G03G 15/00* (2006.01)

(52) U.S. Cl.
CPC ..... *G03G 15/5016* (2013.01); *G03G 15/556* (2013.01)

(58) Field of Classification Search
CPC ..... G03G 15/5016; G03G 15/55; G03G 21/1875; G03G 2221/1892; G03G 15/556
USPC ..... 399/12, 13
See application file for complete search history.

(56) References Cited

U.S. PATENT DOCUMENTS

2005/0206923 A1* 9/2005 Utsumi ..... G03G 15/553 358/1.9
2005/0254841 A1* 11/2005 Tomitaka ..... G03G 15/5079 399/12

FOREIGN PATENT DOCUMENTS

JP 2009-008757 A 1/2009

* cited by examiner

*Primary Examiner* — Sophia S Chen
(74) *Attorney, Agent, or Firm* — Studebaker & Brackett PC

(57) ABSTRACT

An image forming apparatus includes a toner supply section, an image forming section, a touch panel, a determination section, and a display controller. The determination section determines whether a toner container attached to the toner supply section is a first container or a second container which differs from the first container. The display controller determines specific information corresponding to a use rate of the second replacement component and displays the specific information on the display. The specific information is information relating to the replacement component. The use rate indicates a proportion of the number of second containers each used as a toner container.

12 Claims, 10 Drawing Sheets

| Use rate RC (%) | Display condition DC | Display content DG |
|---|---|---|
| 0 | ▪Not displayed | — |
| 25 | A) Upon attachment of second container TC2 | Use rate RC is 0% or 25% |
| 50 | A) Upon attachment of second container TC2<br>B) Upon front cover 101 being opened | Use rate RC is 0%, 25%, or 50%, |
| 75 | A) Upon attachment of second container TC2<br>B) Upon front cover 101 being opened<br>C) Upon power source being turned off | Use rate RC is 0%, 25%, 50%, or 75%, |
| 100 | A) Upon attachment of second container TC2<br>B) Upon front cover 101 being opened<br>C) Upon power source being turned off<br>D) Upon resuming from sleep state | Use rate RC is 0%, 25%, 50%, 75%, or 100%, |

FIG. 4

IMAGE FORMING APPARATUS DISPLAYING SPECIFIC INFORMATION RELATING TO REPLACEMENT COMPONENT ON DISPLAY

INCORPORATION BY REFERENCE

The present application claims priority under 35 U.S.C. § 119 to Japanese Patent Application No. 2017-226740, filed on Nov. 27, 2017. The contents of this application are incorporated herein by reference in their entirety.

BACKGROUND

The present disclosure relates to an image forming apparatus.

A control device of an image forming apparatus performs determination as to whether or not a toner cartridge is an official product or a non-official product. When the toner cartridge is determined to be a non-official product, the control device determines whether to allow or restrict printing operation based on a billing method. Specifically, in a situation in which the billing method is a charging method, the control device prohibits the printing operation such that no sheet of paper is printed. The charging method is a billing method according to the number of printed sheets.

SUMMARY

An image forming apparatus according to the present disclosure includes an attachment portion, an image forming section, a display, a determination section, and a display controller. A replacement component containing a consumable item is to be attached to the attachment portion. The image forming section forms an image on a recording medium through consumption of the consumable item. The determination section determines whether the replacement component attached to the attachment portion is a first replacement component or a second replacement component which differs from the first replacement component. The display controller determines specific information corresponding to a use rate of the second replacement component and displays the specific information on the display. The specific information is information relating to the replacement component. The use rate indicates a proportion of the second replacement component used as the replacement component.

BRIEF DESCRIPTION OF THE DRAWINGS

FIG. 4 is a table indicating a relationship between use rates, display conditions, and display content.

DETAILED DESCRIPTION

Figure 1:
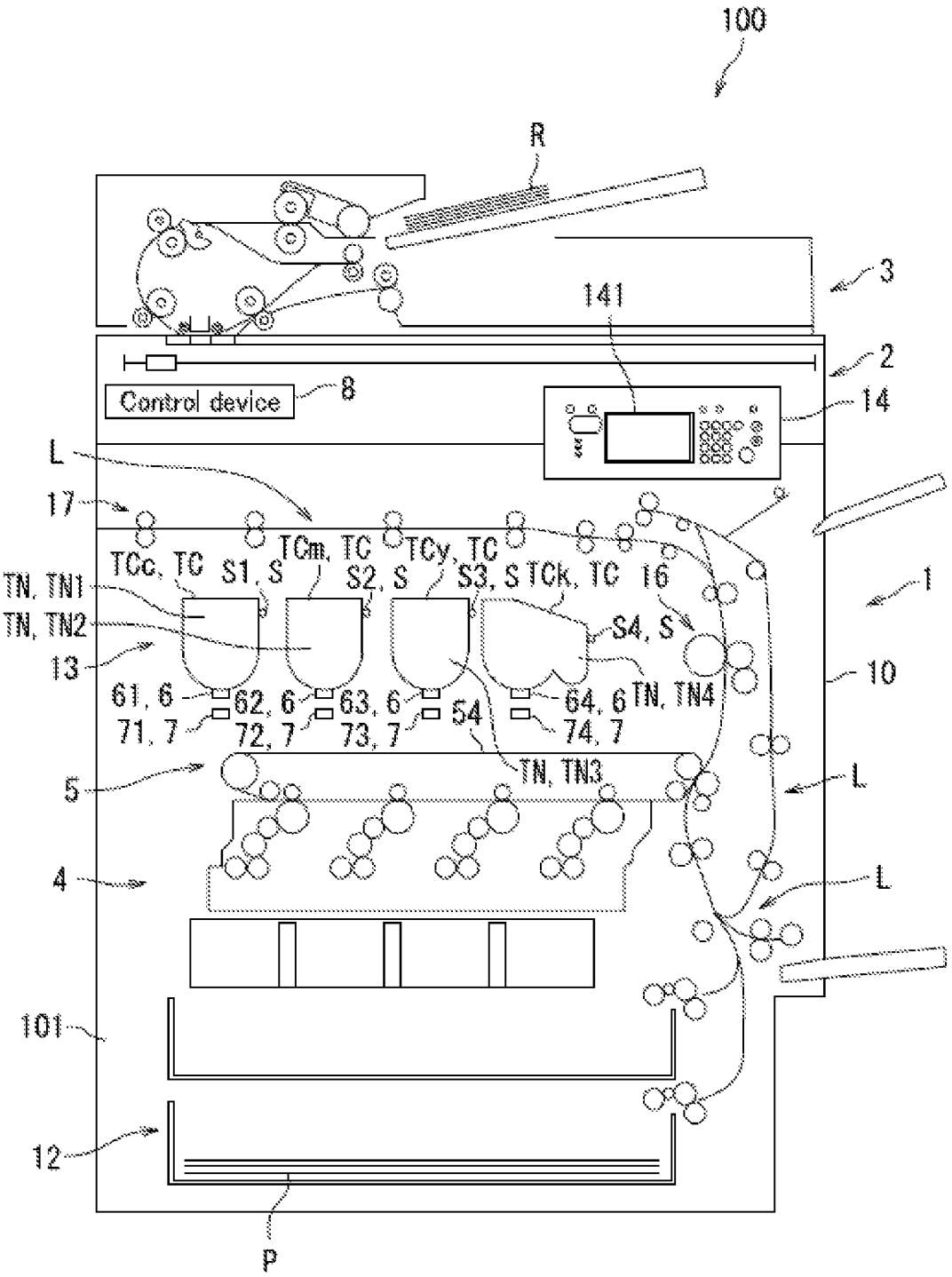
FIG. 1 is a diagram illustrating an example of a configuration of an image forming apparatus according to an embodiment of the present disclosure.

An embodiment of the present disclosure will be described below with reference to the accompanying drawings (FIGS. 1-10). It should be noted that elements in the drawings that are the same or equivalent are labelled using the same reference signs and description thereof is not repeated.

The following describes a configuration of an image forming apparatus 100 according to an embodiment of the present disclosure with reference to FIG. 1. FIG. 1 is a diagram illustrating the configuration of the image forming apparatus 100. The image forming apparatus 100 is a color multifunction peripheral.

As illustrated in FIG. 1, the image forming apparatus 100 includes an image forming unit 1, an image reading unit 2, a document conveyance unit 3, an operation panel 14, and a control device 8. The image forming unit 1 forms an image on a sheet P. The image reading unit 2 reads an image from a document R and generates image information. The document conveyance unit 3 conveys the document R to the image reading unit 2. The operation panel 14 receives user operation. The control device 8 controls operation of the image forming apparatus 100.

The image forming unit 1 includes a casing 10, a feeding section 12, a conveyance section L, a toner supply section 13, an image forming section 4, and an ejection section 17. The image forming section 4 includes a transfer section 5 and a fixing section 16. The casing 10 houses therein the feeding section 12, the conveyance section L, the toner supply section 13, the image forming section 4, and the ejection section 17. The casing 10 includes a front cover 101.

The feeding section 12 feeds the sheet P to the conveyance section L. The conveyance section L conveys the sheet P to the ejection section 17 via the transfer section 5 and the fixing section 16. The sheet P is equivalent to an example of a "recording medium".

The toner supply section 13 supplies toner to the image forming section 4. A toner container TCc, a toner container TCm, a toner container TCy, and a toner container TCk are attached to the toner supply section 13. The toner containers TCc to TCk are equivalent to an example of a "specific number of replacement components". In the following description, each of the toner containers TCc to TCk may be referred generally to as a toner container TC. The toner supply section 13 is equivalent to an example of an "attachment portion".

The toner container TCc contains a cyan toner TN1. The toner container TCc supplies the cyan toner TN1 to the image forming section 4. The toner container TCm contains a magenta toner TN2. The toner container TCm supplies the magenta toner TN2 to the image forming section 4. The toner container TCy contains a yellow toner TN3. The toner container TCy supplies the yellow toner TN3 to the image forming section 4. The toner container TCk contains a black toner TN4. The toner container TCk supplies the black toner TN4 to the image forming section 4. The cyan toner TN1, the magenta toner TN2, the yellow toner TN3, and the black toner TN4 each are equivalent to an example of a "consumable item". In the following description, each of the cyan toner TN1, the magenta toner TN2, the yellow toner TN3, and the black toner TN4 may be referred generally to as a toner TN.

The toner container TCc includes an integrated circuit (IC) tag 61. The IC tag 61 is disposed on a peripheral surface of the toner container TCc. The IC tag 61 stores therein identification information JDc of the toner container TCc. The toner container TCm includes an IC tag 62. The IC tag 62 is disposed on a peripheral surface of the toner container TCm. The IC tag 62 stores therein identification information JDm of the toner container TCm.

The toner container TCy includes an IC tag 63. The IC tag 63 is disposed on a peripheral surface of the toner container TCy. The IC tag 63 stores therein identification information JDy of the toner container TCy. The toner container TCk includes an IC tag 64. The IC tag 64 is disposed on a peripheral surface of the toner container TCk. The IC tag 64 stores therein identification information JDk of the toner container TCk. In the following description, each of the IC tags 61 to 64 may be referred generally to as an IC tag 6. Also, each of the identification information JDc, the identification information JDm, the identification information JDy, and the identification information JDk may be referred generally to as identification information JD.

The toner container TC is attachable to and detachable from the toner supply section 13. The front cover 101 is opened for detachment of the toner container TC from the toner supply section 13. The front cover 101 is also opened for attachment of the toner container TC to the toner supply section 13. The toner supply section 13 includes a remaining toner sensor S1, a reader 71, a remaining toner sensor S2, a reader 72, a remaining toner sensor S3, a reader 73, a remaining toner sensor S4, and a reader 74.

The remaining toner sensor S1 detects an amount RTc of remaining cyan toner TN1 contained in the toner container TCc. The reader 71 reads the identification information JDc of the toner container TCc from the IC tag 61. The remaining toner sensor S2 detects an amount RTm of remaining magenta toner TN2 contained in the toner container TCm. The reader 72 reads the identification information JDm of the toner container TCm from the IC tag 62.

The remaining toner sensor S3 detects an amount RTy of remaining yellow toner TN3 contained in the toner container TCy. The reader 73 reads the identification information JDy of the toner container TCy from the IC tag 63. The remaining toner sensor S4 detects an amount RTk of remaining black toner TN4 contained in the toner container TCk. The reader 74 reads the identification information JDk of the toner container TCk from the IC tag 64. In the following description, each of the remaining toner sensors S1 to S4 may be referred generally to below as a remaining toner sensor S. Also, each of the readers 71 to 74 may be referred generally to as a reader 7. Each of the amounts RTc, RTm, RTy, and RTk may be referred generally to as an amount RT.

The image forming section 4 forms an image on the sheet P. The transfer section 5 includes an intermediate transfer belt 54. The image forming section 4 transfers toner images in respective colors of cyan, magenta, yellow, and black onto the intermediate transfer belt 54. The toner images in the respective colors are superimposed on the intermediate transfer belt 54, thereby forming an image on the intermediate transfer belt 54. The transfer section 5 transfers the image formed on the intermediate transfer belt 54 onto the sheet P. Through the above, the image is formed on the sheet P. The image forming section 4 will be described later in detail with reference to FIG. 2.

The fixing section 16 applies heat and pressure to the sheet P to fix the image formed on the sheet P to the sheet P. The ejection section 17 ejects the sheet P out of the image forming apparatus 100.

The operation panel 14 includes a touch panel 141. The touch panel 141 includes a liquid crystal display (LCD), for example, and displays various images. The touch panel 141 further includes a touch sensor to receive user operation. The touch panel 141 is equivalent to an example of a "display".

The control device 8 includes a processor and storage. The processor includes for example a central processing unit (CPU). The storage includes memory such as semiconductor memory, and may include a hard disk drive (HDD). The storage stores control programs therein.

Figure 2:
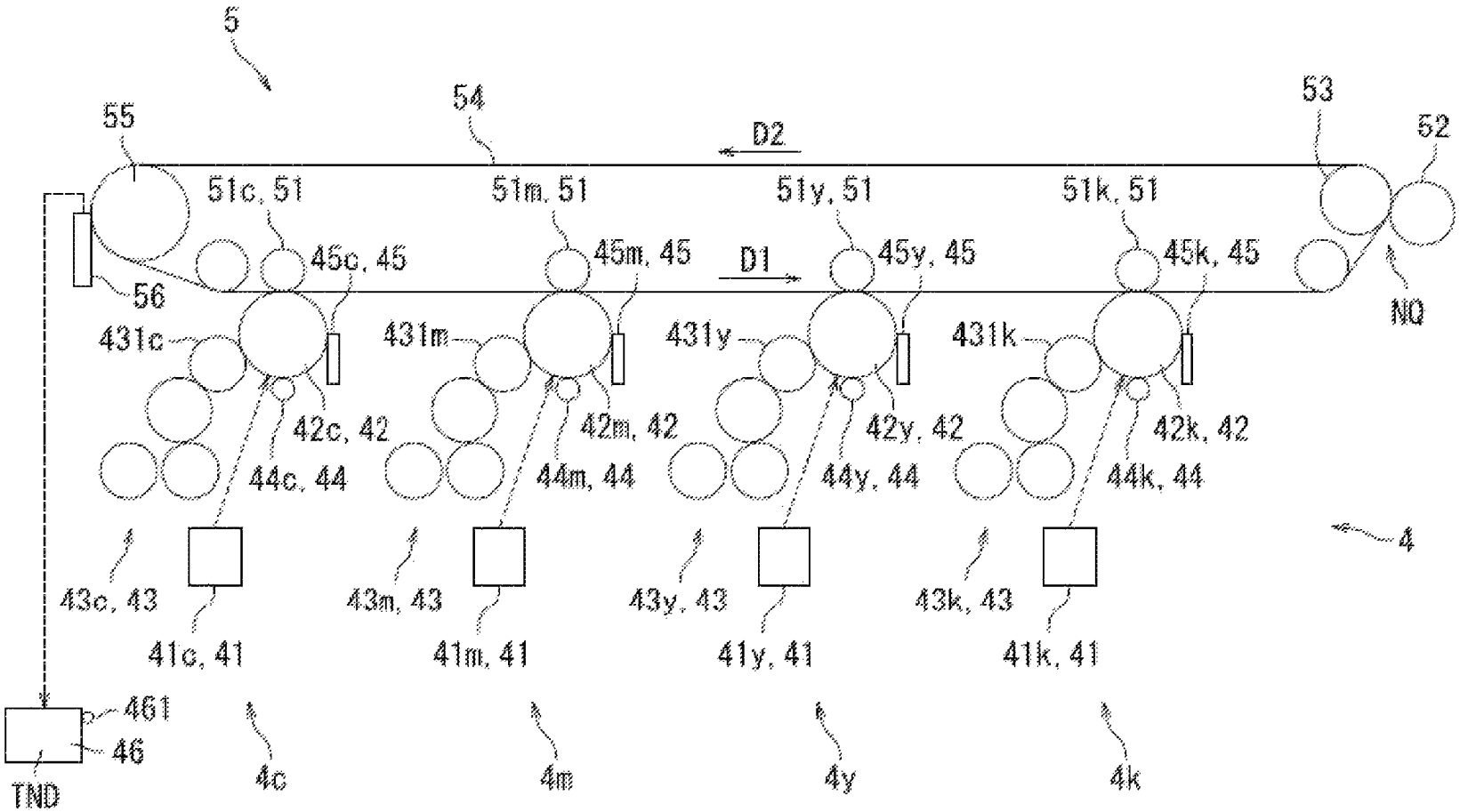
FIG. 2 is a diagram illustrating an example of a configuration of an image forming section according to the embodiment of the present disclosure.

The following describes a configuration of the image forming section 4 according to the embodiment of the present disclosure with reference to FIGS. 1 and 2. FIG. 2 is a diagram illustrating an example of the configuration of the image forming section 4. As illustrated in FIG. 2, the image forming section 4 includes an image forming section 4*c*, an image forming section 4*m*, an image forming section 4*y*, and an image forming section 4*k*.

Each of the image forming sections 4*c*, 4*m*, 4*y*, and 4*k* includes a light exposure section 41, a photosensitive drum 42, a developing section 43, a charging roller 44, and a cleaning blade 45. Configurations of the image forming sections 4*c*, 4*m*, 4*y*, and 4*k* are substantially the same as one another other than that colors of the supplied toners TN are different from one another. Therefore, the configuration of only the image forming section 4*c* to which the cyan toner TN1 is supplied will be described in the following description and explanation of the configurations of the image forming sections 4 other than the image forming section 4*c*, that is, the image forming sections 4*m*, 4*y*, and 4*k* is omitted.

The image forming section 4*c* includes a light exposure section 41*c* (41), a photosensitive drum 42*c* (42), a developing section 43*c* (43), a charging roller 44*c* (44), and a cleaning blade 45*c* (45).

The charging roller 44*c* charges the photosensitive drum 42*c* to a specific potential. The light exposure section 41*c* irradiates the photosensitive drum 42*c* with laser light for light exposure to form an electrostatic latent image on the photosensitive drum 42*c*. The developing section 43*c* includes a development roller 431*c*. The development roller 431*c* supplies the cyan toner TN1 onto an irradiated portion of the photosensitive drum 42*c* to develop the electrostatic latent image into a toner image. Through the above, a cyan toner image is formed on a peripheral surface of the photosensitive drum 42*c*.

The cleaning blade 45*c* has a tip end (upper end in FIG. 2) that is in contact with the peripheral surface of the photosensitive drum 42*c*. When the tip end of the cleaning blade 45*c* slides on the peripheral surface of the photosensitive drum 42*c*, cyan toner TN1 remaining on the peripheral surface of the photosensitive drum 42*c* is removed.

The transfer section 5 transfers the toner images onto the sheet P. The transfer section 5 includes primary transfer rollers 51, a secondary transfer roller 52, a drive roller 53, the intermediate transfer belt 54, and a driven roller 55. The primary transfer rollers 51 transfer toner images in respective colors of cyan, magenta, yellow, and black from the photosensitive drums 42 to the intermediate transfer belt 54. The primary transfer rollers 51 include a primary transfer roller 51*c*, a primary transfer roller 51*m*, a primary transfer roller 51*y*, and a primary transfer roller 51*k*.

The drive roller 53 drives the intermediate transfer belt 54. The intermediate transfer belt 54 is an endless belt wound around the primary transfer rollers 51, the drive roller 53, and the driven roller 55. The intermediate transfer belt 54 is rotationally driven by the drive roller 53 in a counterclockwise direction as indicated by arrows D1 and D2. The driven roller 55 is rotationally driven along with rotation of the intermediate transfer belt 54. A blade 56 removes toner TN remaining on a surface of the intermediate transfer belt 54.

The image forming section 4 is configured such that a waste toner container 46 is attachable to and detachable from the image forming section 4. The waste toner container 46 contains waste toner TND. The waste toner TND includes toner TN removed by the cleaning blade 45 and toner TN removed by the blade 56.

The image forming section 4 further includes a waste toner amount sensor 461. The waste toner amount sensor 461 detects an amount of the waste toner TND contained in the waste toner container 46.

The secondary transfer roller 52 is pressed by the drive roller 53 to form a nip part NQ between the secondary transfer roller 52 and the drive roller 53. The secondary transfer roller 52 transfers the toner images on the intermediate transfer belt 54 onto the sheet P while the sheet P passes through the nip part NQ.

Figure 3:
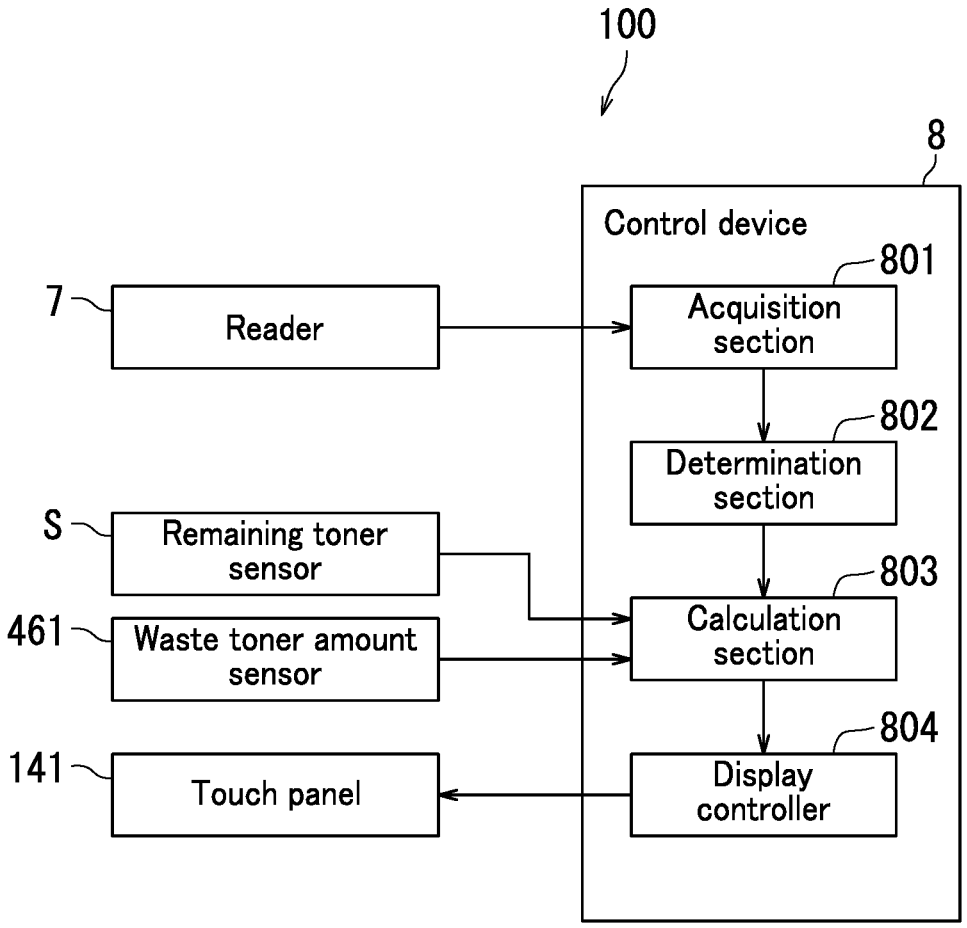
FIG. 3 is a diagram illustrating an example of a configuration of a control device according to the embodiment of the present disclosure.

The following describes a configuration of the control device 8 according to the embodiment of the present disclosure with reference to FIGS. 1 to 3. FIG. 3 is a diagram illustrating an example of the configuration of the control device 8.

As illustrated in FIG. 3, the control device 8 includes an acquisition section 801, a determination section 802, a calculation section 803, and a display controller 804. Specifically, the processor of the control device 8 executes control programs to function as the acquisition section 801, the determination section 802, the calculation section 803, and the display controller 804.

The acquisition section 801 acquires the identification information JD of each toner container TC attached to the toner supply section 13 through a corresponding one of the readers 7.

The determination section 802 determines whether or not the toner container TC attached to the toner supply section 13 is a first container TC1 or a second container TC2 which differs from the first container TC1. The first container TC1 is for example a dedicated toner container. The second container TC2 is for example a non-dedicated toner container.

Specifically, the determination section 802 determines whether or not the toner container TC is a first container TC1 or a second container TC2 by referencing the identification information JD of the toner container TC.

The calculation section 803 calculates a use rate RC of a second container TC2. The use rate RC indicates a proportion of second containers TC2 used as the toner container TC. Specifically, the use rate RC indicates a ratio of the number of second containers TC2 to the total number (for example, 4) of the toner containers TC (toner containers TCc to TCk).

For example, in a situation in which each of the four toner containers TC is a first container TC1, the use rate RC is 0% (=0/4×100). In a situation in which only one of the toner containers TC (e.g., the toner container TCc) is a second container TC2, the use rate RC is 25% (=1/4×100). In a situation in which only two of the toner containers TC (e.g., the toner containers TCc and TCk) are second containers TC2, the use rate RC is 50% (=2/4×100). In a situation in which each of the four toner containers TC is a second container TC2, the use rate RC is 100% (=4/4×100).

The display controller 804 determines specific information JP corresponding to the use rate RC of the second container TC2 and displays the specific information JP on the touch panel 141. The specific information JP is information relating to the toner containers TC. Specifically, the specific information JP indicates information relating to variable cost of the image forming apparatus 100. More specifically, the specific information JP contains a consumption CS of the toners TN, the number NJ of jam occurrences in the image forming section 4, and a power consumption Q of the image forming apparatus 100.

As described with reference to FIGS. 1 to 3, the display controller 804 determines the specific information JP corresponding to the use rate RC of the second container TC2 and displays the determined specific information JP on the touch panel 141 in the embodiment of the present disclosure. The specific information JP indicates information relating to the variable cost of the image forming apparatus 100. For example, the display controller 804 displays the consumption CS of the toners TN in a situation in which the use rate RC is a first use rate RC1 and the consumption CS of the toners TN in a situation in which the use rate RC is a second use rate RC2 lower than the first use rate RC1. In a situation as above, the user can compare the consumption CS of the toners TN in a situation in which the use rate RC is the first use rate RC1 with that in a situation in which the use rate RC is the second use rate RC2. Thus, user convenience can be improved.

Furthermore, the specific information JP indicates information relating to the variable cost of the image forming apparatus 100. The user can accordingly recognize that the variable cost is for example higher in a situation in which at least one second container TC2 is used than in a situation in which only first containers TC1 are used. Thus, user convenience can be further improved.

Moreover, the specific information JP contains the consumption CS of the toners TN, the number NJ of jam occurrences in the image forming section 4, and the power consumption Q of the image forming apparatus 100. The user can accordingly recognize that the consumption CS of the toners TN is for example higher in a situation in which at least one second container TC2 is used than in a situation in which only first containers TC1 are used. Thus, user convenience can be further improved.

The use rate RC also indicates a ratio of the number of second containers TC2 to the total number (for example, 4) of the toner containers TC. The use rate RC therefore can be easily calculated.

Note that the specific information JP contains the consumption CS of the toners TN, the number NJ of jam occurrences in the image forming section 4, and the power consumption Q of the image forming apparatus 100 in the embodiment of the present disclosure, which however should not be taken to limit the present disclosure. It is only required that the specific information JP contain at least one of the consumption CS of the toners TN, the number NJ of jam occurrences in the image forming section 4, and the power consumption Q of the image forming apparatus 100. For example, the specific information JP may only indicate the consumption CS of the toners TN. In the above configuration, processing by the control device 8 can be simplified. Alternatively, the specific information JP may contain an amount of generated waste toner TND. The amount of the generated waste toner TND is detected by the waste toner amount sensor 461.

Note that the sheet P may be broken upon occurrence of a jam. Therefore, the larger the number NJ of jam occurrences is, the larger the number of sheets P to be wasted is. As such, the number NJ of jam occurrences is associated with the variable cost (for example, an amount of use of the sheets P).

Furthermore, a toner TN contained in a second container TC2 (for example, a non-dedicated toner container) may be inferior in fixability compared to a toner TN contained in a first container TC1 (for example, a dedicated toner container). Therefore, it is possible that fixing temperature is higher in a situation in which at least one second container TC2 is used than in a situation in which only first containers TC1 are used. The higher the fixing temperature is, the more the sheet P tends to thermally deform in the fixing section 16. Accordingly, the number NJ of jam occurrences may be larger in a situation in which at least one second container TC2 is used than in a situation in which only first containers TC1 are used. That is, the number NJ of jam occurrences is information in association with the toner containers TC. Therefore, the number NJ of jam occurrences is contained in the specific information JP.

The configuration of the control device 8 will be further described with reference to FIGS. 3 to 6. FIG. 4 is a table indicating a relationship between the use rates RC, display conditions DC, and display content DG The display conditions DC indicate conditions under which the display controller 804 displays a container comparison screen 900 on the touch panel 141. The display content DG indicates content that the display controller 804 displays on the container comparison screen 900. The container comparison screen 900 is a screen indicating a relationship between the use rate RC and the specific information JP. The container comparison screen 900 will be described later in detail with reference to FIGS. 5 and 6.

The display controller 804 determines a frequency of the specific information JP being displayed according to the use rate RC. Specifically, the display controller 804 sets the frequency of the specific information JP being displayed to be higher with an increase in the use rate RC. More specifically, the display controller 804 sets the frequency of the container comparison screen 900 being displayed as the use rate RC increases. The following describes processing by the display controller 804 in further detail with reference to FIG. 4.

As shown under "Display condition DC" in FIG. 4, the display controller 804 does not display the container comparison screen 900 when the use rate RC is 0%.

When the use rate RC is 25%, the display controller 804 displays the container comparison screen 900 upon attachment of a second container TC2 to the toner supply section 13, as shown under "Display condition DC". Pieces of the specific information JP in a situation in which the use rate RC is 0% or 25% are displayed on the container comparison screen 900, as shown under "Display content DG".

When the use rate RC is 50%, the display controller 804 displays the container comparison screen 900 upon attachment of second containers TC2 to the toner supply section 13 and upon the front cover 101 being opened, as shown under "Display condition DC". Pieces of the specific information JP in a situation in which the use rate RC is 0%, 25%, or 50% are displayed on the container comparison screen 900, as shown under "Display content DG".

When the use rate RC is 75%, the display controller 804 displays the container comparison screen 900 upon attachment of second containers TC2 to the toner supply section 13, upon the front cover 101 being opened, and upon a power source of the image forming apparatus 100 being turned off, as shown under "Display condition DC". Pieces of the specific information JP in a situation in which the use rate RC is 0%, 25%, 50%, or 75% are displayed on the container comparison screen 900, as shown under "Display content DG".

When the use rate RC is 100%, the display controller 804 displays the container comparison screen 900 upon attachment of second containers TC2 to the toner supply section 13, upon the front cover 101 being opened, upon the power source being turned off, and upon the image forming apparatus 100 resuming from a sleep state, as shown under "Display condition DC". Pieces of the specific information JP in respective situations in which the use rate RC is 0%, 25%, 50%, 75%, and 100% are displayed on the container comparison screen 900, as shown under "Display content DG".

As described above with reference to FIGS. 3 and 4, the frequency of the specific information JP being displayed is determined according to the use rate RC in the embodiment of the present disclosure. For example, the frequency of the specific information JP being displayed is increased as the use rate RC of a second container TC2 (for example, a non-dedicated official product) increases. Thus, the user can surely confirm the specific information JP. Thus, user convenience can be improved.

Note that the specific information JP is displayed on the container comparison screen 900 in the embodiment of the present disclosure, which however should not be taken to limit the present disclosure. It is only required that the display controller 804 display the specific information JP on the touch panel 141. For example, the display controller 804 may display the specific information JP on the touch panel 141 in a pop up manner. Alternatively, the display controller 804 may display the specific information JP on the touch panel 141 as a character image.

Figure 5:
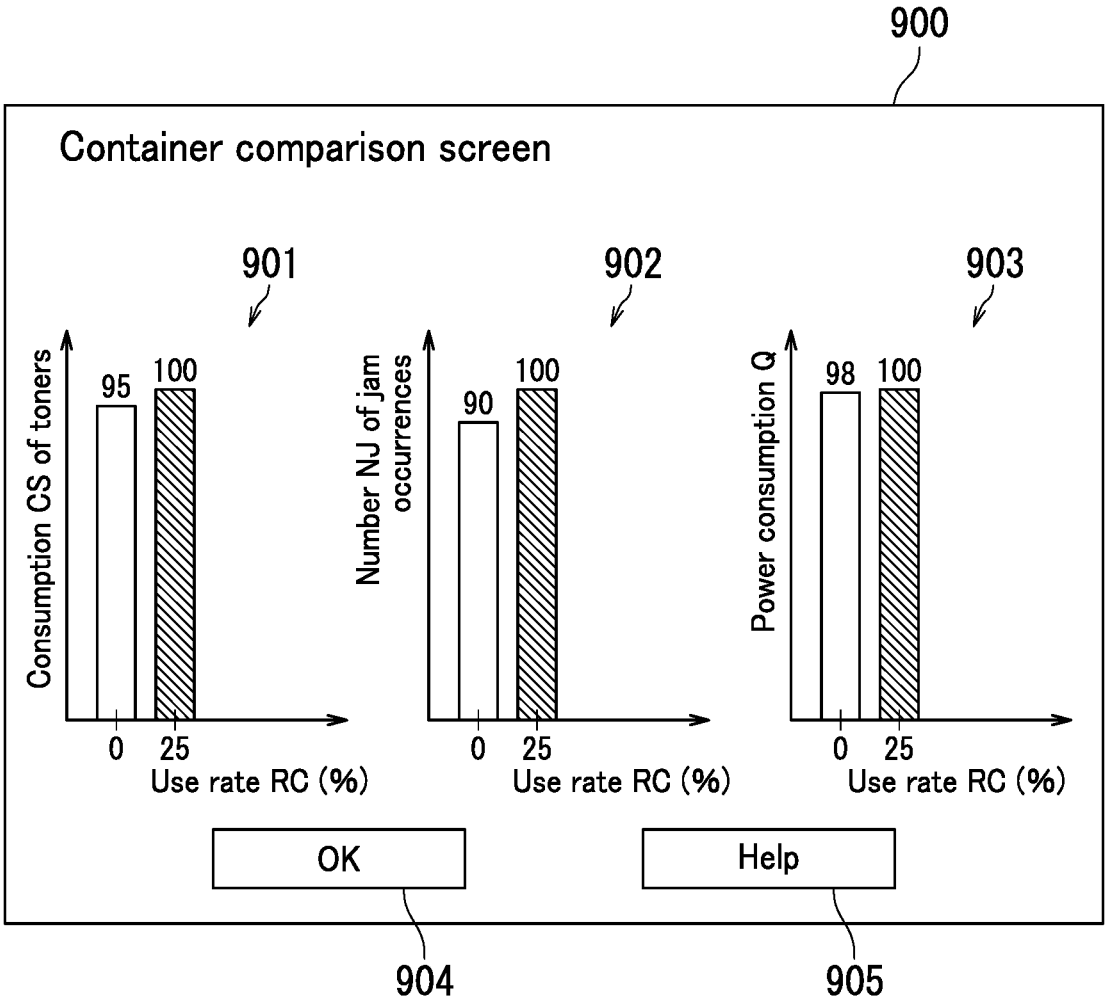
FIG. 5 is a screen diagram illustrating an example of a container comparison screen that is displayed on a touch panel.

FIG. 5 is a screen diagram illustrating an example of the container comparison screen 900 that is displayed on the touch panel 141. As illustrated in FIG. 5, a first graph display area 901, a second graph display area 902, a third graph display area 903, an OK button 904, and a help button 905 are displayed on the container comparison screen 900. When the use rate RC is 25%, the display controller 804 displays the container comparison screen 900 illustrated in FIG. 5 on the touch panel 141.

A graph indicating a relationship between the use rate RC and the consumption CS of the toners TN is displayed in the first graph display area 901. The horizontal axis of the graph indicates the use rate RC, while the vertical axis thereof indicates the consumption CS of the toners TN. The graph includes a first bar indicating the consumption CS in a situation in which the use rate RC is 0% and a second bar indicating the consumption CS in a situation in which the use rate RC is 25%. The second bar is hatched to indicate that the current use rate RC is 25%. That the consumption CS decreases to 95% when the use rate RC changes from 25% to 0% is indicated through affixation of "100" to the second bar and "95" to the first bar.

A graph indicating a relationship between the use rate RC and the number NJ of jam occurrences is displayed in the second graph display area 902. The horizontal axis of the graph indicates the use rate RC, while the vertical axis thereof indicates the number NJ of jam occurrences. The graph includes a first bar indicating the number NJ of jam occurrences in a situation in which the use rate RC is 0% and a second bar indicating the number NJ of jam occurrences in a situation in which the use rate RC is 25%. The second bar is hatched to indicate that the current use rate RC is 25%. That the number NJ of jam occurrences decreases to 90% when the use rate RC is changed from 25% to 0% is indicated through affixation of "100" to the second bar and "90" to the first bar.

A graph indicating a relationship between the use rate RC and the power consumption Q is displayed in the third graph display area 903. The horizontal axis of the graph indicates the use rate RC, while the vertical axis thereof indicates the power consumption Q. The graph includes a first bar indicating the power consumption Q in a situation in which the use rate RC is 0% and a second bar indicating the power consumption Q in a situation in which the use rate RC is 25%. The second bar is hatched to indicate that the current use rate RC is 25%. That the power consumption Q decreases to 98% when the use rate RC is changed from 25% to 0% is indicated through affixation of "100" to the second bar and "98" to the first bar.

Having confirmed the content of the container comparison screen 900, the user presses the OK button 904. Upon the OK button 904 being pressed, the display controller 804 hides the container comparison screen 900.

When desiring to inquire about the display content of the container comparison screen 900, the user presses the help button 905. Upon the help button 905 being pressed, a screen explaining the display content of the display controller 804 is displayed. It is possible to display a contact address of an administrator of the image forming apparatus 100 upon the help button 905 being pressed.

As described with reference to FIGS. 3 to 5, the display controller 804 displays the specific information JP corresponding to the first use rate RC1 (for example, 25%) and the specific information JP corresponding to the second use rate RC2 (for example, 0%) in the embodiment of the present disclosure. The second use rate RC2 is smaller than the first use rate RC1. In the above configuration, the user can compare the specific information JP corresponding to the first use rate RC1 with the specific information JP corresponding to the second use rate RC2. Thus, user convenience can be further improved.

Note that the display controller 804 displays the specific information JP corresponding to the first use rate RC1 and the specific information JP corresponding to the second use rate RC2 in the embodiment of the present disclosure, which however should not be taken to limit the present disclosure. It is only required that the display controller 804 display the specific information JP corresponding to the first use rate RC1 and the specific information JP corresponding to a use rate RC different from the first use rate RC1. For example, it is possible to display the specific information JP corresponding to the first use rate RC1 (for example, 25%) and the specific information JP corresponding to a third use rate RC3 (for example, 50%). The third use rate RC3 is larger than the first use rate RC1. In the above configuration, the user can compare the specific information JP corresponding to the first use rate RC1 with the specific information JP corresponding to the third use rate RC3. Thus, user convenience can be further improved.

The use rate RC indicates a ratio of the number of second containers TC2 to the total number (for example, 4) of the toner containers TC in the embodiment of the present disclosure, which however should not be taken to limit the present disclosure. It is possible to calculate the use rate RC based on a result of determination by the determination section 802 and respective weights distributed to the plurality of (for example, 4) toner containers TC.

For example, the use rate RC may be calculated based on the following equation (1).

$$RC=W1\times F(TCc)+W2\times F(TCm)+W3\times F(TCy)+W4\times F(TCk) \quad (1)$$

Wherein, W1 to W4 represent weights of the toner containers TCc to TCk, respectively. F(TCc) is a function with a value of "1" when the toner container TCc is a second container TC2 and "0" when the toner container TCc is a first container TC1. F(TCm) is a function with a value of "1" when the toner container TCm is a second container TC2 and "0" when the toner container TCm is a first container TC1. F(TCy) is a function with a value of "1" when the toner container TCy is a second container TC2 and "0" when the toner container TCy is a first container TC1. F(TCk) is a function with a value of "1" when the toner container TCk is a second container TC2 and "0" when the toner container TCk is a first container TC1.

In the above case, for example, a use rate RC agreeing with actual use can be calculated by setting the weight (for example, W4) of a toner container TC (for example, the toner container TCk) having the highest usage frequency of the toner containers TC to be larger than the weights (for example, W1 to W3) of the other toner containers TC (for example, the toner containers TCc, TCm, and TCy).

Alternatively, the use rate RC may be calculated based on an accumulated value CSA1 of a consumption CS1 of a first toner TNA and an accumulated value CSA2 of a consumption CS2 of a second toner TNB for each of the multiple (for example, 4) color toners TN. Note that the first toner TNA refers to a toner TN contained in the first container TC1 and the second toner TNB refers to a toner TN contained in the second container TC2.

For example, the use rate RC may be calculated based on the following equation (2).

$$RC=CSA2/(CSA1+CSA2) \quad (2)$$

In this case, the use rate RC agreeing with accrual use can be calculated for each of the multiple color toners TN.

Figure 6:
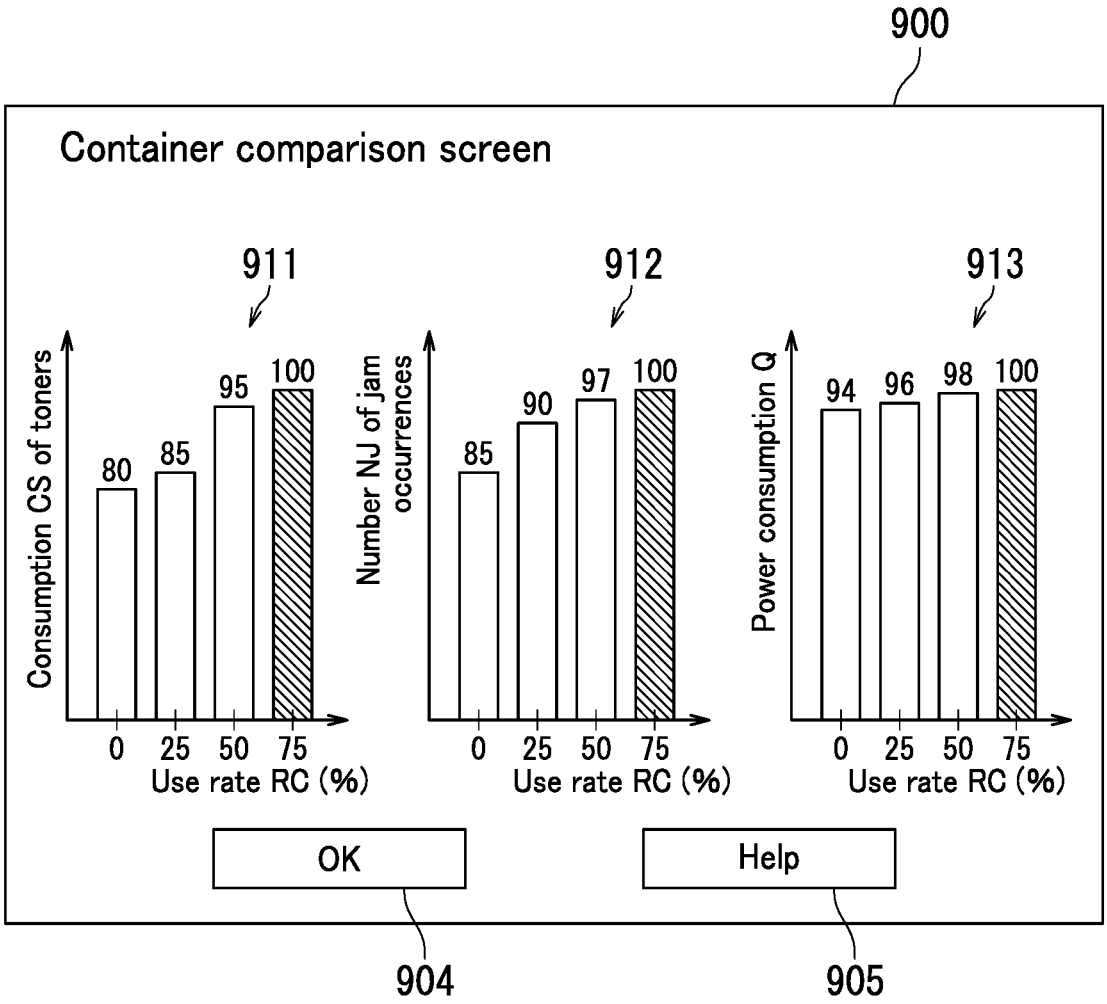
FIG. 6 is a screen diagram illustrating another example of the container comparison screen that is displayed on the touch panel.

FIG. 6 is a screen diagram illustrating another example of the container comparison screen 900 that is displayed on the touch panel 141. When the use rate RC is 75%, the display controller 804 displays the container comparison screen 900 illustrated in FIG. 6 on the touch panel 141. The container comparison screen 900 illustrated in FIG. 6 is different from that illustrated in FIG. 5 in the first use rate RC1. That is, the first use rate RC1 on the container comparison screen 900 in FIG. 5 is 25%, whereas the first use rate RC1 on the container comparison screen 900 in FIG. 6 is 75%. The first use rate RC1 indicates the use rate RC in the image forming apparatus 100.

As illustrated in FIG. 6, a first graph display area 911, a second graph display area 912, a third graph display area 913, an OK button 904, and a help button 905 are displayed on the container comparison screen 900. The OK button 904 is the same as the OK button 904 displayed on the container comparison screen 900 illustrated in FIG. 5, and the help button 905 is the same as the help button 905 displayed on the container comparison screen 900 illustrated in FIG. 5. Therefore, explanation of thereof is omitted.

A graph indicating a relationship between the use rate RC and the consumption CS of the toners TN is displayed in the first graph display area 911. The horizontal axis of the graph indicates the use rate RC, while the vertical axis indicates the consumption CS of the toners TN. The graph includes a first bar indicating the consumption CS in a situation in which the use rate RC is 0%, a second bar indicating the consumption CS in a situation in which the use rate RC is 25%, a third bar indicating the consumption CS in a situation in which the use rate RC is 50%, and a fourth bar indicating the consumption CS in a situation in which the use rate RC is 75%. The fourth bar is hatched to indicate that the current use rate RC is 75%.

Note that "100" is affixed to the fourth bar, "95" is affixed to the third bar, "85" is affixed to the second bar, and "80" is affixed to the first bar. Such affixes indicate that the consumption CS decreases to 95% when the use rate RC is changed from 75% to 50%, decreases to 85% when the use rate RC is changed from 75% to 25%, and decreases to 80% when the use rate RC is changed from 75% to 0%.

A graph indicating a relationship between the use rate RC and the number NJ of jam occurrences is displayed in the second graph display area 912. The horizontal axis of the graph indicates the use rate RC, while the vertical axis indicates the number NJ of jam occurrences. The graph includes a first bar indicating the number NJ of jam occurrences in a situation in which the use rate RC is 0%, a second bar indicating the number NJ of jam occurrences in a situation in which the use rate RC is 25%, a third bar indicating the number NJ of jam occurrences in a situation in which the use rate RC is 50%, and a fourth bar indicating the number NJ of jam occurrences in a situation in which the use rate RC is 75%. The fourth bar is hatched to indicate that the current use rate RC is 75%.

Note that "100" is affixed to the fourth bar, "97" is affixed to the third bar, "90" is affixed to the second bar, and "85" is affixed to the first bar. Such affixes indicate that the number NJ of jam occurrences decreases to 97% when the use rate RC is changed from 75% to 50%, decreases to 90% when the use rate RC is changed from 75% to 25%, and decreases to 85% when the use rate RC is changed from 75% to 0%.

A graph indicating a relationship between the use rate RC and the power consumption Q is displayed in the third graph display area 913. The horizontal axis of the graph indicates the use rate RC, while the vertical axis thereof indicates the power consumption Q. The graph includes a first bar indicating the power consumption Q in a situation in which the use rate RC is 0%, a second bar indicating the power consumption Q in a situation in which the use rate RC is 25%, a third bar indicating the power consumption Q in a situation in which the use rate RC is 50%, and a fourth bar indicating the power consumption Q in a situation in which the use rate RC is 75%. The fourth bar is hatched to indicate that the current use rate RC is 75%.

Note that "100" is affixed to the fourth bar, "98" is affixed to the third bar, "96" is affixed to the second bar, and "94" is affixed to the first bar. Such affixes indicate that the power consumption Q decreases to 98% when the use rate RC is changed from 75% to 50%, decreases to 96% when the use rate RC is changed from 75% to 25%, and decreases to 94% when the use rate RC is changed from 75% to 0%.

As described with reference to FIGS. 3 to 6, the display controller 804 displays the specific information JP corresponding to the first use rate RC1 (for example, 75%) and the specific information JP corresponding to the second use rate RC2 (for example, 50%, 25%, or 0%) in the embodiment of the present disclosure. The second use rate RC2 is smaller than the first use rate RC1. In the above configuration, the user can compare the specific information JP corresponding to the first use rate RC1 with the specific information JP corresponding to the second use rates RC2. Thus, user convenience can be further improved.

Furthermore, multiple pieces of the specific information JP corresponding to the multiple second use rates RC2 (for example, 50%, 25%, and 0%) are displayed. This can enable comparison between the specific information JP corresponding to the first use rate RC1 and the multiple pieces of the specific information JP corresponding to the multiple second use rates RC2. Thus, user convenience can be further improved.

Moreover, the image forming section 4 is capable of forming a color image on the sheet P through consumption of the toners TN in multiple (for example, 4) colors and the specific information JP is information relating to the multiple (for example, 4) toner containers TC. In the above configuration, the user can confirm information relating to the toner containers TC in the image forming apparatus 100 that is capable of forming color images. Thus, user convenience can be further improved.

Figure 7:
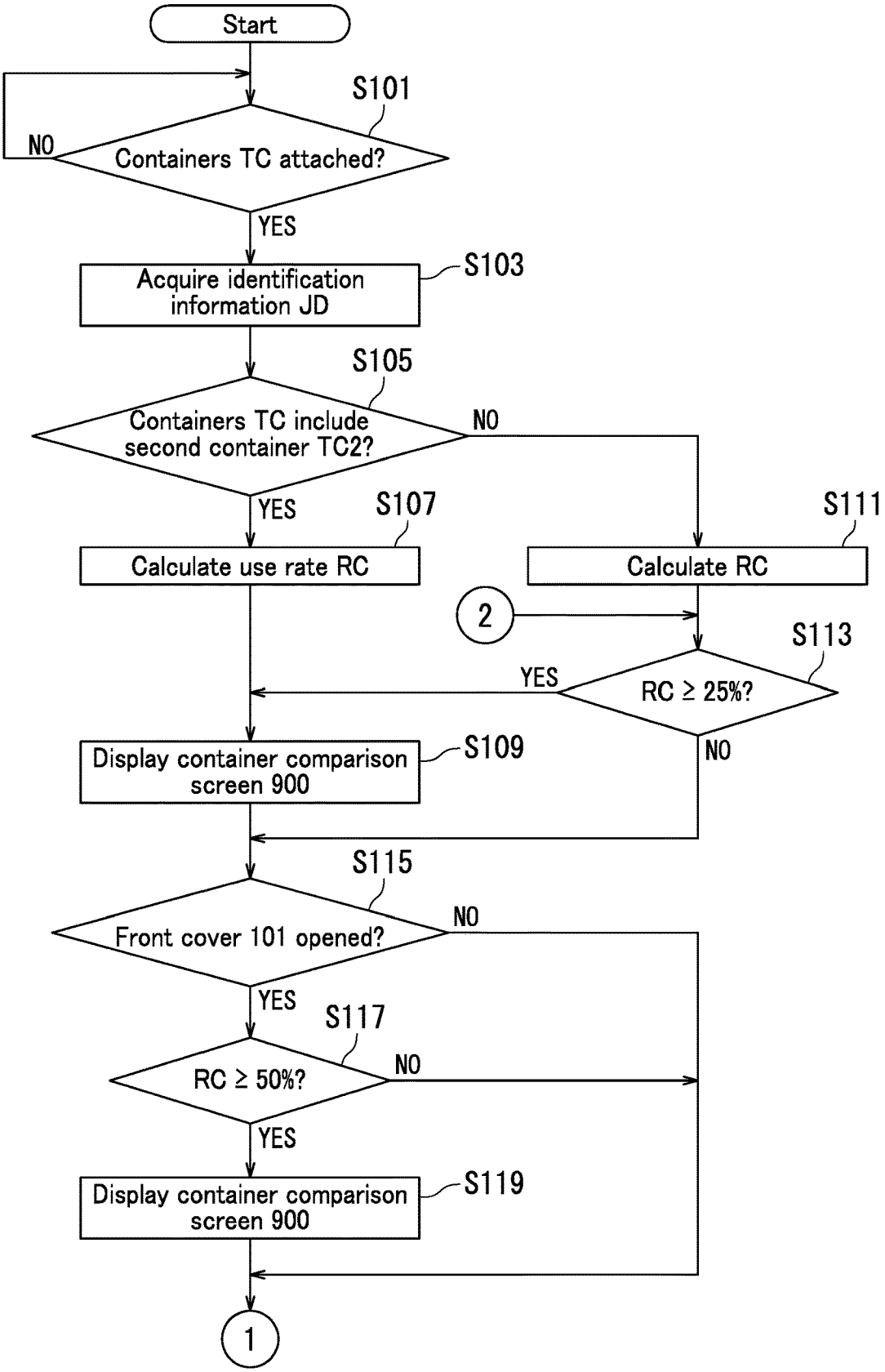
FIG. 7 is a flowchart depicting an example of processing performed by the control device.
Figure 8:
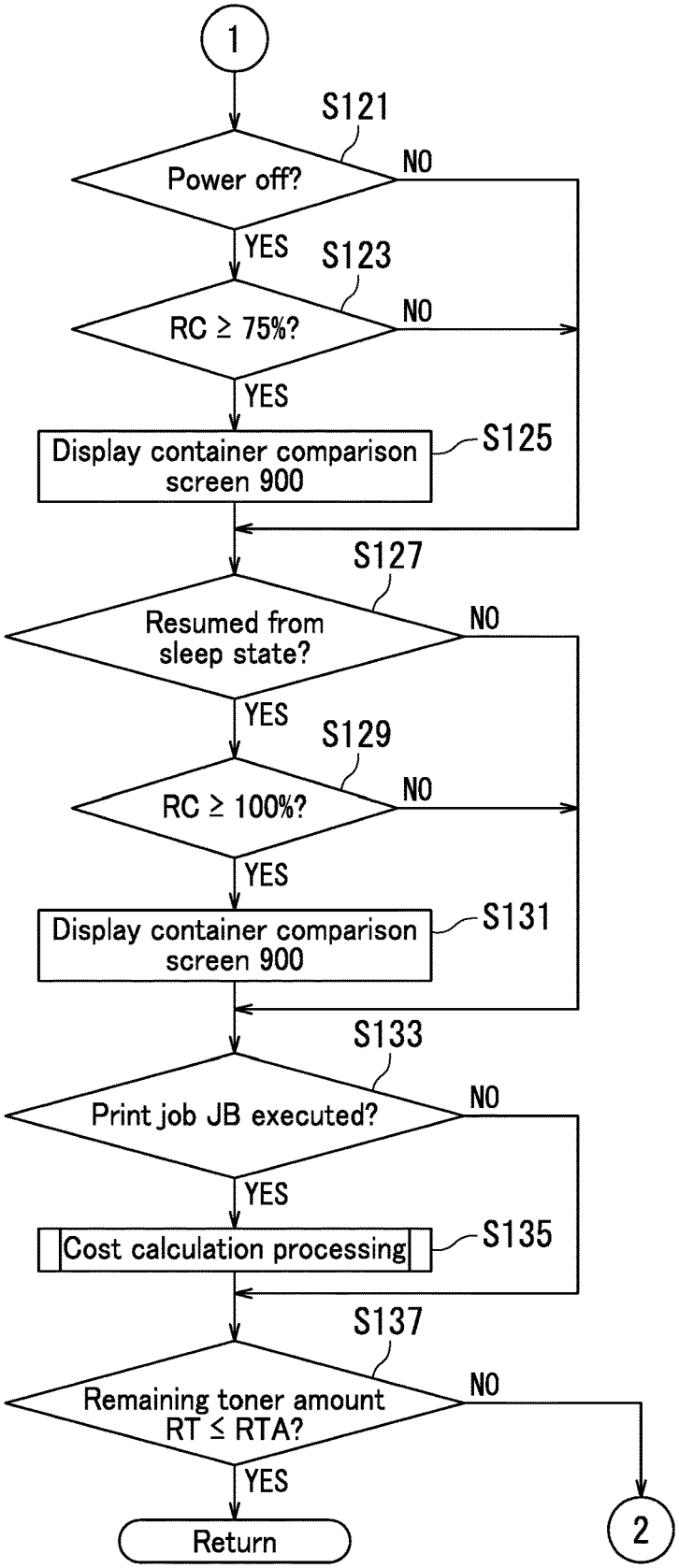
FIG. 8 is a flowchart depicting the example of the processing performed by the control device.

The following describes processing performed by the control device 8 with reference to FIGS. 3 to 9. FIGS. 7 and 8 are flowcharts depicting an example of processing performed by the control device 8.

As depicted in FIG. 7, the control device 8 first determines whether or not toner containers TC are attached to the toner supply section 13 at Step S101.

When the control device 8 determines that at least one toner container TC is not attached to the toner supply section 13 (NO at Step S101), the processing is suspended. When the control device 8 determines that four toner containers TC are attached to the toner supply section 13 (YES at Step S101), the processing proceeds to Step S103.

At Step S103, the acquisition section 801 acquires the identification information JD of each toner container TC attached to the toner supply section 13.

At Step S105, the determination section 802 then determines whether or not any of the toner containers TC attached to the toner supply section 13 is a second container TC2.

When the determination section 802 determines that at least one of the toner containers TC attached to the toner supply section 13 is a second container TC2 (YES at Step S105), the processing proceeds to Step S107.

At Step S107, the calculation section 803 calculates the use rate RC of the second container TC2. The processing then proceeds to Step S109.

When the determination section 802 determines that all of the toner containers TC attached to the toner supply section 13 are first containers TC1 (NO at Step S105), the processing proceeds to Step S111.

At Step S111, the calculation section 803 calculates the use rate RC of the second container TC2.

Subsequently, at Step S113, the control device 8 determines whether or not the use rate RC is at least 25%.

When the control device 8 determines that the use rate RC is less than 25% (NO at Step S113), the processing proceeds to Step S115. When the control device 8 determines that the use rate RC is at least 25% (YES at Step S113), the processing proceeds to Step S109.

At Step S109, the display controller 804 displays the container comparison screen 900 on the touch panel 141.

Next, at Step S115, the control device 8 determines whether or not the front cover 101 is open.

When the control device 8 determines that the front cover 101 is closed (NO at Step S115), the processing proceeds to Step S121 depicted in FIG. 8. When the control device 8 determines that the front cover 101 is open (YES at Step S115), the processing proceeds to Step S117.

At Step S117, the control device 8 determines whether or not the use rate RC is at least 50%.

When the control device 8 determines that the use rate RC is less than 50% (NO at Step S117), the processing proceeds to Step S121 depicted in FIG. 8. When the control device 8 determines that the use rate RC is at least 50% (YES at Step S117), the processing proceeds to Step S119.

At Step S119, the display controller 804 displays the container comparison screen 900 on the touch panel 141. The processing then proceeds to Step S121 depicted in FIG. 8.

Subsequently, the control device 8 determines at Step S121 whether or not the power source is turned off, as depicted in FIG. 8.

When the control device 8 determines that the power source is not turned off (NO at Step S121), the processing proceeds to Step S127. When the control device 8 determines that the power source is turned off (YES at Step S121), the processing proceeds to Step S123.

At Step S123, the control device 8 determines whether or not the use rate RC is at least 75%.

When the control device 8 determines that the use rate RC is less than 75% (NO at Step S123), the processing proceeds to Step S127. When the control device 8 determines that the use rate RC is at least 75% (YES at Step S123), the processing proceeds to Step S125.

At Step S125, the display controller 804 displays the container comparison screen 900 on the touch panel 141.

Next, at Step S127, the control device 8 determines whether or not the image forming apparatus 100 has resumed from a sleep state.

When the control device 8 determines that the image forming apparatus 100 has not resumed from the sleep state (NO at Step S127), the processing proceeds to Step S133. When the control device 8 determines that the image forming apparatus 100 has resumed from the sleep state (YES at Step S127), the processing proceeds to Step S129.

At Step S129, the control device 8 determines whether or not the use rate RC is at least 100%.

When the control device 8 determines that the use rate RC is less than 100% (NO at Step S129), the processing proceeds to Step S133. When the control device 8 determines that the use rate RC is at least 100% (YES at Step S129), the processing proceeds to Step S131.

At Step S131, the display controller 804 displays the container comparison screen 900 on the touch panel 141.

Next, at Step S133, the control device 8 determines whether or not a print job JB has been executed.

When the control device 8 determines that the print job JB has not been executed (NO at Step S133), the processing proceeds to Step S137. When the control device 8 determines that the print job JB has been executed (YES at Step S133), the processing proceeds to Step S135.

At Step S135, the control device 8 executes "cost calculation processing". The cost calculation processing refers to processing to calculate the specific information JP that is to be displayed on the touch panel 141. Specifically, the cost calculation processing refers to processing to calculate the consumption CS of the toners TN, the number NJ of jam occurrences in the image forming section 4, and the power consumption Q of the image forming apparatus 100.

Subsequently, at Step S137, the control device 8 determines whether or not the amounts RT of respective remaining toners TN each are equal to or smaller than a specific amount RTA. The specific amount RTA is set to be an extremely small (for example, 2 g). That is, the control device 8 determines whether or not each toner container TC is empty.

When the control device 8 determines that the amount RT of remaining toner TN in each of the toner containers TC is larger than the specific amount RTA (NO at Step S137), the processing returns to Step S113 in FIG. 7. When the control device 8 determines that the amount RT of the remaining toner TN in any of the toner containers TC is equal to or smaller than the specific amount RTA (YES at Step S137), the processing returns to Step S101 in FIG. 7.

Figure 9:
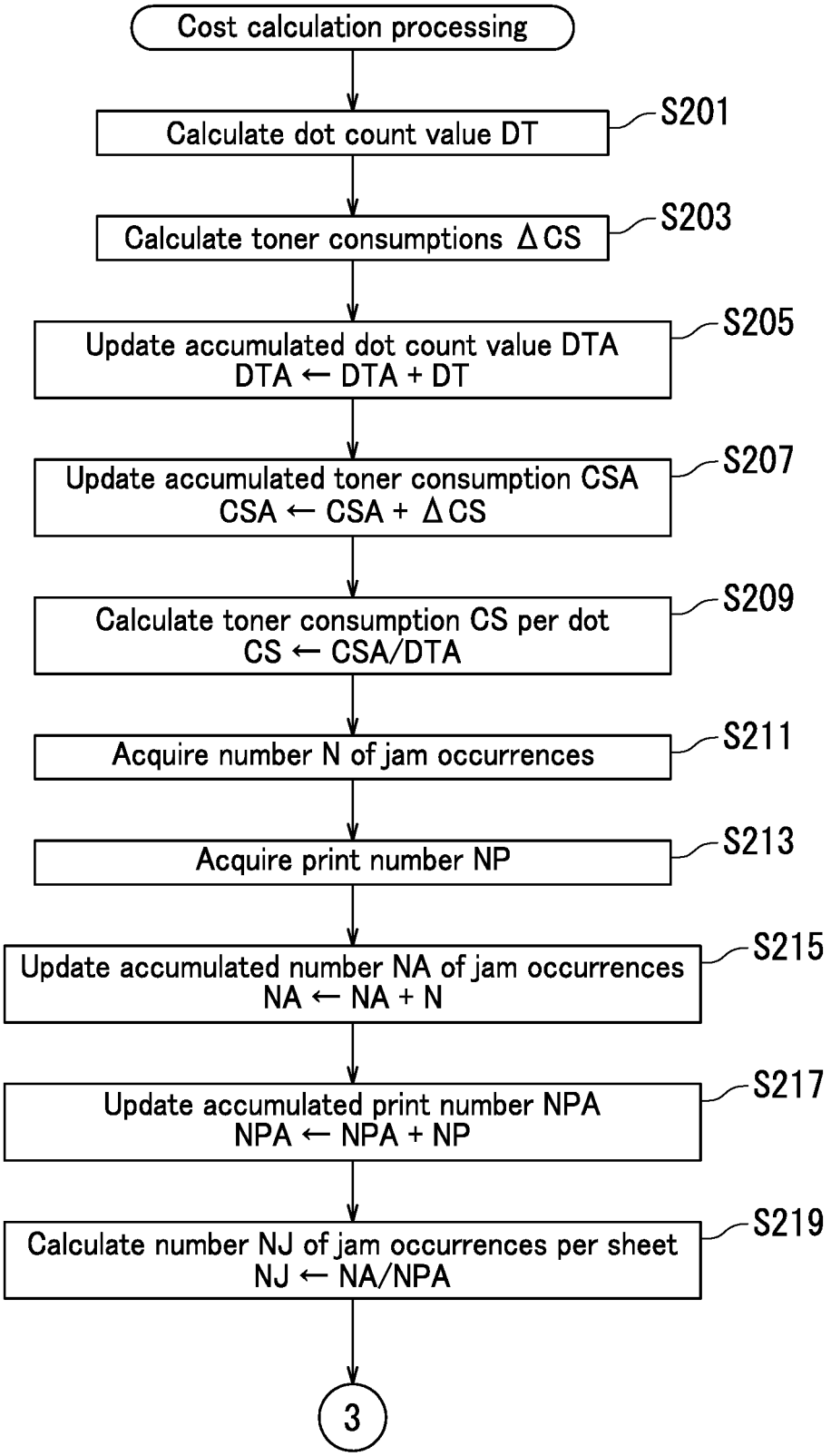
FIG. 9 is a flowchart depicting an example of cost calculation processing performed by the control device.
Figure 10:
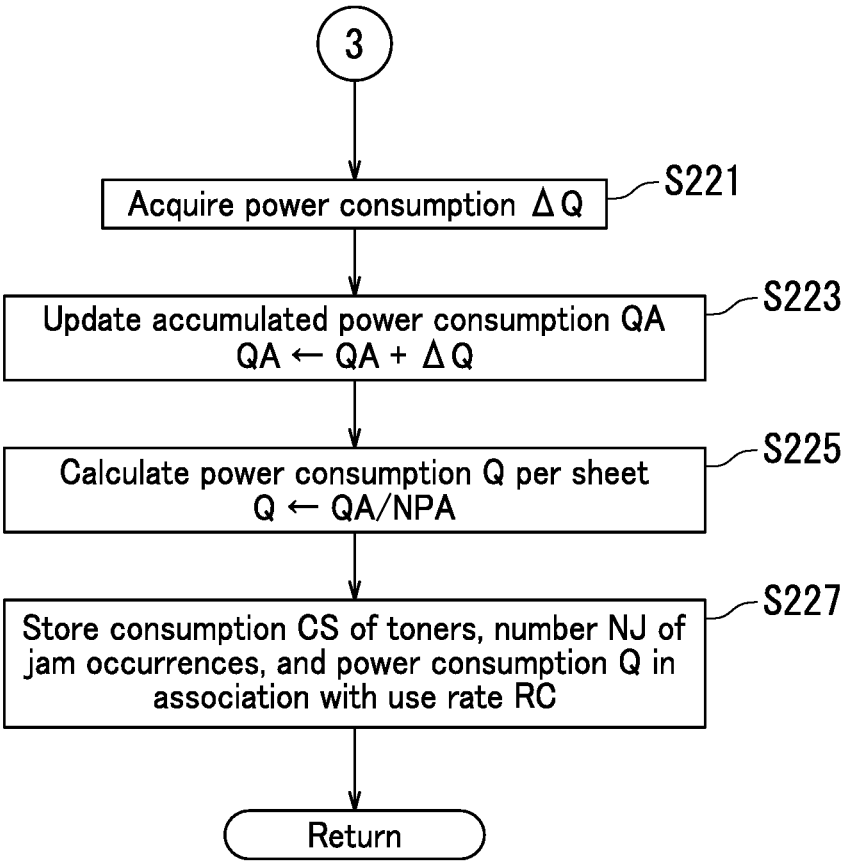
FIG. 10 is a flowchart depicting the example of the cost calculation processing performed by the control device.

The following describes the cost calculation processing performed by the control device 8 with reference to FIGS. 9 and 10. FIGS. 9 and 10 are flowcharts depicting an example of the cost calculation processing performed by the control device 8.

As depicted in FIG. 9, the control device 8 first calculates a dot count value DT at Step S201. The dot count value DT indicates the total number of dots included in an image that the image forming section 4 has formed on the sheet P.

Next at Step S203, the control device 8 calculates a toner consumption ΔCS. The toner consumption ΔCS indicates a difference obtained by subtracting the amount RT of the remaining toners TN after execution of the print job JB from the amount RT of the remaining toners TN before execution of the print job JB.

Next, at Step S205, the control device 8 updates an accumulated dot count value DTA such that the accumulated dot count value DTA is increased by the dot count value DT. The accumulated dot count value DTA indicates an accumulated value of dot count values DT.

Next, at Step S207, the control device 8 updates an accumulated toner consumption CSA such that the accumulated toner consumption CSA is increased by the toner consumption ΔCS. The accumulated toner consumption CSA indicates an accumulated value of the toner consumption ΔCS.

Subsequently, at Step S209, the control device 8 calculates a toner consumption CS per dot by dividing the accumulated toner consumption CSA by the accumulated dot count value DTA.

Next, at Step S211, the control device 8 acquires the number N of jam occurrences in the image forming section 4.

Next, at Step S213, the control device 8 acquires a print number NP for the print job JB. The print number NP indicates the number of sheets P on which an image has been formed in execution of the print job JB.

At Step S215, the control device 8 then updates an accumulated number NA of jam occurrences such that the accumulated number NA of jam occurrences is increased by the number N of jam occurrences. The accumulated number NA of jam occurrences indicates an accumulated value of the numbers N of jam occurrences.

Next, at Step S217, the control device 8 then updates an accumulated print number NPA such that the accumulated print number NPA is increased by the print number NP. The accumulated print number NPA indicates an accumulated value of the print numbers NP.

Next, at Step S219, the control device 8 calculates the number NJ of jam occurrences per sheet by dividing the accumulated number NA of jam occurrences by the accumulated print number NPA.

Subsequently, as depicted in FIG. 10, the control device 8 acquires a power consumption ΔQ at Step S221. The power consumption ΔQ indicates an amount of power consumed in execution of the print job JB.

Next, at Step S223, the control device 8 updates an accumulated power consumption QA such that the accumulated power consumption QA is increased by the power consumption ΔQ. The accumulated power consumption QA indicates an accumulated value of the power consumption ΔQ.

Next, at Step S225, the control device 8 calculates the power consumption Q per sheet by dividing the accumulated power consumption QA by the accumulated print number NPA.

Next, at Step S227, the control device 8 stores the consumption CS of the toners TN, the number NJ of jam occurrences, and the power consumption Q in association with the use rate RC in the storage. The processing then returns to Step S137 in FIG. 8.

As described with reference to FIGS. 3 to 10, the frequency of the container comparison screen 900 being displayed is increased as the use rate RC increases in the embodiment of the present disclosure. In the above configuration, the user can reliably confirm the specific information JP. Thus, user convenience can be further improved.

Note that the toner consumption per dot is calculated as the consumption CS of the toners TN in the embodiment of the present disclosure, which however should not be taken to limit the present disclosure. For example, a toner consumption per a specific number of dots (for example, 1,000 dots) may be calculated as the consumption CS of the toners TN. Alternatively, for example, a toner consumption per a specific printing rate (for example, a printing rate of 10%) may be calculated as the consumption CS of the toners TN.

The term "printing rate" refers to a ratio (SR1/SR2) of an integrated area SR1 of an image formed on the sheet P to an area SR2 of the sheet P. Specifically, the integrated area SR1 represents a sum of an integrated area of an image formed on the sheet P with the cyan toner TN1, an integrated area of an image formed on the sheet P with the magenta toner TN2, an integrated area of an image formed on the sheet P with the yellow toner TN3, and an integrated area of an image formed on the sheet P with the black toner TN4.

The number of jam occurrences per sheet is calculated as the number NJ of jam occurrences in the embodiment of the present disclosure, which however should not be taken to limit the present disclosure. For example, the number of jam occurrences per a specific number of sheets (for example, 1,000 sheets) may be calculated as the number NJ of jam occurrences.

Furthermore, the power consumption per sheet is calculated as the power consumption Q in the embodiment of the present disclosure, which however should not be taken to limit the present disclosure. For example, the power consumption Q per a specific number of sheets (for example, 1,000 sheets) may be calculated as the power consumption Q.

An embodiment of the present disclosure has been described so far with reference to the drawings. However, the present disclosure is not limited to the above-described embodiment and can be practiced in various ways within the scope not departing from the gist of the present disclosure (e.g., (1) to (3)) described below). The drawings are intended to mainly illustrate elements of configuration in a schematic manner to assist with understanding. The thickness, the length, the number, and so on of each element of configuration illustrated are not true to scale for diagrammatic purposes. The shape, the dimension, and so on of each element of configuration shown in the above-described embodiment are exemplary only and not particularly limited. Various alternations can be made thereto within the scope not substantially departing from the configuration of the present disclosure.

(1) As described with reference to FIGS. 1 and 2, the toners TN each are the "consumable item" and the toner containers TC each are the "replacement component" in the embodiment of the present disclosure, which however should not be taken to limit the present disclosure. It is only required that an image be formed on a sheet P through consumption of at least one "consumable item". For example, the consumable item may be an ink and the replacement component may be an ink cartridge. In the above case, the "image forming apparatus" is an inkjet recording apparatus.

(2) As described with reference to FIGS. 1 and 2, the image forming apparatus 100 is a color multifunction peripheral in the embodiment of the present disclosure, which however should not be taken to limit the present disclosure. It is only required that the image forming apparatus 100 form an image on the sheet P. For example, the image forming apparatus 100 may be a monochrome multifunction peripheral or a color printer.

(3) As described with reference to FIGS. 1 to 3, the first container TC1 is a dedicated toner container and the second container TC2 is a non-dedicated toner container in the embodiment of the present disclosure, which however should not be taken to limit the present disclosure. It is only required that the first container TC1 contain a "first-quality" toner and the second container TC2 contains a "second-quality" toner. The first-quality toner is different in quality from the second-quality toner. For example, the first-quality toner is superior in quality to the second-quality toner.

What is claimed is:

1. An image forming apparatus comprising:

an attachment portion to which a replacement component containing a consumable item is to be attached;

an image forming section configured to form an image on a recording medium through consumption of the consumable item;

a display;

a determination section configured to determine whether the replacement component attached to the attachment portion is a first replacement component or a second replacement component which differs from the first replacement component; and a display controller configured to display on the display specific information that is information relating to the replacement component, determine specific information corresponding to a use rate of the second replacement component, and determine a frequency of the specific information being displayed according to the use rate, wherein the use rate indicates a proportion of the second replacement component used as the replacement component.

2. The image forming apparatus according to claim 1, wherein the specific information indicates information relating to variable cost of the image forming apparatus.

3. The image forming apparatus according to claim 2, wherein the specific information contains at least one of the consumption of the consumable item, a number of jam occurrences in the image forming section, and a power consumption of the image forming apparatus.

4. The image forming apparatus according to claim 1, wherein the display controller increases the frequency of the specific information being displayed as the use rate increases.

5. The image forming apparatus according to claim 1, wherein the use rate includes a first use rate and a second use rate smaller than the first use rate, the first use rate indicates a use rate in the image forming apparatus, and the display controller displays specific information corresponding to the first use rate and specific information corresponding to the second use rate.

6. The image forming apparatus according to claim 5, wherein the use rate further includes a third use rate larger than the first rate, and the display controller further displays specific information corresponding to the third use rate.

7. The image forming apparatus according to claim 1, wherein when the determination section determines that the replacement component is the second replacement component, the display controller displays the specific information on the display.

8. An image forming apparatus comprising:

an attachment portion to which a replacement component containing a consumable item is to be attached;

an image forming section configured to form an image on a recording medium through consumption of the consumable item;

a display;

a determination section configured to determine whether the replacement component attached to the attachment portion is a first replacement component or a second replacement component which differs from the first replacement component; and a display controller configured to display on the display the specific information that is information relating to the replacement component, and determine specific information corresponding to a use rate of the second replacement component, wherein the use rate indicates a proportion of the second replacement component used as the replacement component, a specific number of replacement components that contain consumable items are attached to the attachment portion, the replacement component and at least one additional replacement component together forming the specific number of replacement components, colors of the consumable items being different from each other, the image forming section is capable of forming a color image on the recording medium through consumption of the consumable items different in color, the determination section determines whether the replacement components each are the first replacement component or the second replacement component, and the specific information is information relating to the specific number of replacement components.

9. The image forming apparatus according to claim 8, further comprising a calculation section configured to calculate the use rate, wherein the calculation section calculates as the use rate a ratio of a number of second replacement components attached to the attachment portion to the specific number of the replacement components.

10. The image forming apparatus according to claim 8, further comprising a calculation section configured to calculate the use rate, wherein a weight is distributed to the specific number of replacement components, and the calculation section calculates the use rate based on the weight and a result of determination by the determination section.

11. The image forming apparatus according to claim 8, further comprising a calculation section configured to calculate the use rate, wherein the calculation section calculates the use rate for each of the consumable items different in color based on an accumulated value of consumption of a first consumable item and an accumulated value of consumption of a second consumable item, the first consumable item is a consumable item contained in the first replacement component, and the second consumable item is a consumable item contained in the second replacement component.

12. An image forming apparatus comprising:

an attachment portion to which a replacement component containing a consumable item is to be attached;

an image forming section configured to form an image on a recording medium through consumption of the consumable item;

a display;

a determination section configured to determine whether the replacement component attached to the attachment portion is a first replacement component or a second replacement component which differs from the first replacement component;

a display controller configured to display on the display the specific information that is information relating to the replacement component, and determine specific information corresponding to a use rate of the second replacement component; and a cover that is opened in attachment of the replacement component to the attachment portion, wherein the use rate indicates a proportion of the second replacement component used as the replacement component, and includes a first use rate and a second use rate that is smaller than the first use rate, the first use rate indicates a use rate of the image forming apparatus, when the cover is opened in a situation in which the use rate is equal to or larger than the first use rate, the display controller displays specific information corresponding to the first use rate and specific information corresponding to the second use rate on the display.

* * * * *